US007111733B1

(12) United States Patent
Foote

(10) Patent No.: US 7,111,733 B1
(45) Date of Patent: Sep. 26, 2006

(54) MEDICINE VIAL ORGANIZER AND CARRIER

(76) Inventor: Majorie Foote, 19601 Silver Springs, Southfield, MI (US) 48076

( * ) Notice: Subject to any disclaimer, the term of this patent is extended or adjusted under 35 U.S.C. 154(b) by 0 days.

(21) Appl. No.: 10/952,561

(22) Filed: Sep. 27, 2004

Related U.S. Application Data

(60) Provisional application No. 60/511,990, filed on Oct. 16, 2003.

(51) Int. Cl.
*B65D 83/04* (2006.01)

(52) U.S. Cl. ..... 206/528; 383/38

(58) Field of Classification Search ..... 206/223, 206/232, 315.11, 528, 540, 570, 579; 190/107, 190/109; 383/38–40
See application file for complete search history.

(56) References Cited

U.S. PATENT DOCUMENTS 2,961,108 A * 11/1960 Johnson ..... 206/459.5
3,134,416 A * 5/1964 Magyar ..... 383/39
4,738,547 A * 4/1988 Brown ..... 383/39
4,949,843 A * 8/1990 Stokes ..... 383/38
5,447,215 A * 9/1995 Volkmar et al. ..... 190/110
5,984,092 A * 11/1999 Heard-Willmon ..... 206/232
6,250,470 B1 * 6/2001 Mackenzie ..... 190/109

* cited by examiner

*Primary Examiner*—Luan K. Bui
(74) *Attorney, Agent, or Firm*—John R. Benefiel

(57) ABSTRACT

A prescription pill container organizer and carrier includes one or more rows of elastic loop holders attached to the inside of a piece of flexible material in which are held prescription pill containers, the piece folded or rolled up to enclose the prescription pill containers. Pockets for documents and a tethered magnifier for reading the prescription pill containers labels are also installed next to the rows of holders.

7 Claims, 2 Drawing Sheets

MEDICINE VIAL ORGANIZER AND CARRIER

CROSS REFERENCE TO RELATED APPLICATIONS

This application claims the benefit of U.S. provisional Ser. No. 60/511,990, filed Oct. 16, 2003.

BACKGROUND OF THE INVENTION

This invention concerns organizing and carrying containers for prescription pills. Many older persons regularly take a number of medications and particularly prescription pills to control various chronic conditions occurring in old age, such as diabetes, high blood pressure, elevated cholesterol, etc. Younger persons sometimes also regularly take a number of medicines in a regular regimen. It would be advantageous to be able to organize the containers of pills to keep them orderly and to make sure the proper pills are taken at the times as directed, and to be sure the pills are properly taken according to the instructions.

Such persons of course must take their medicines with them when going out for an extended time or when traveling and it would be advantageous to have a convenient carrier for their pills.

Commonly, when going to see medical practitioners or being admitted to a medical facility it is necessary to have the pill containers available as well as the associated prescriptions and other documents.

Medical personnel will often wish to obtain accurate information concerning the medication the person is taking, and often request that patients bring in their medications and prescriptions. Some convenient and accurate means of providing this information would be helpful in these situations.

It is object of the present invention to provide a convenient carrier and organizer for prescription pills and related papers.

SUMMARY OF THE INVENTION

The above object and other objects which will be understood upon a reading of the following specification and claims, are achieved by the combination of containers of prescription pills and a carrier-organizer and a carrier-organizer constructed from a piece of fabric or other flexible sheet material having an array of stretchable strap prescription pill container holders attached on one side, preferably in one or more rows allowing the prescription pill containers to be held therein in one or more rows. The holders preferably are flexible strap loops which are narrow enough to expose the labels on a pill container held therein for convenient reference.

The flexible sheet piece can be comprised of several panel sections which can be closed up by being folded or rolled up and secured to enclose and secure the prescription pill containers therein for transport.

In the folded up condition, the outer most panel forms a flap-closure detachably secured with hook and loop straps.

One or more document pockets are also formed in the inside of one of the panels.

A clear plastic magnifier strip is held on a tether fixed to the inside of the fabric piece, which may be tucked into a pocket.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
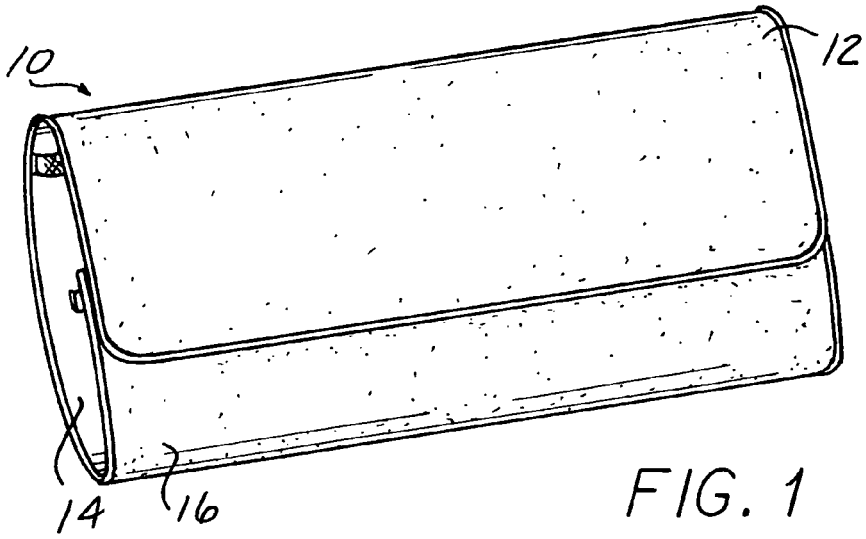
FIG. 1 is a pictorial view of a prescription pill container organizer and carrier combination according to the present invention.

Referring to the drawings, and particularly FIG. 1 the combination prescription pill organizer and carrier 10 according to the invention when closed resembles a pocketbook, formed from a sheet piece or other flexible material including three panels or sections 12, 14, 16 connected along adjacent sides to be able to be folded up with the lower section or panel 16 folded over the center panel 14 and the upper panel 12 folded over the center section or panel 14 and lower section or panel 16 as seen in FIG. 1.

Each panel 12, 14, 16 is preferably formed of durable flexible sheet material, having an outer layer of woven nylon or Dacron fabric. Leather or other higher quality material may also be used. An inside liner 15 can be included of a smoother fabric, with a piping hem 17 around the outside perimeter to create an attractive pocketbook appearance.

The center panel 14 has an array comprised of two rows of container holders 18 attached to the inside thereof. Such holders 18 may comprise elastic straps having each end sewn or otherwise attached to the panel 14. The prescription pill container holders 18 are sized to receive and retain typically sized pill container 20 which typically comprise tubular bottles with caps as shown.

The lower panel 16 has one or more pockets 22 able to receive documents such as prescriptions, medication information sheets, etc.

Figure 3:
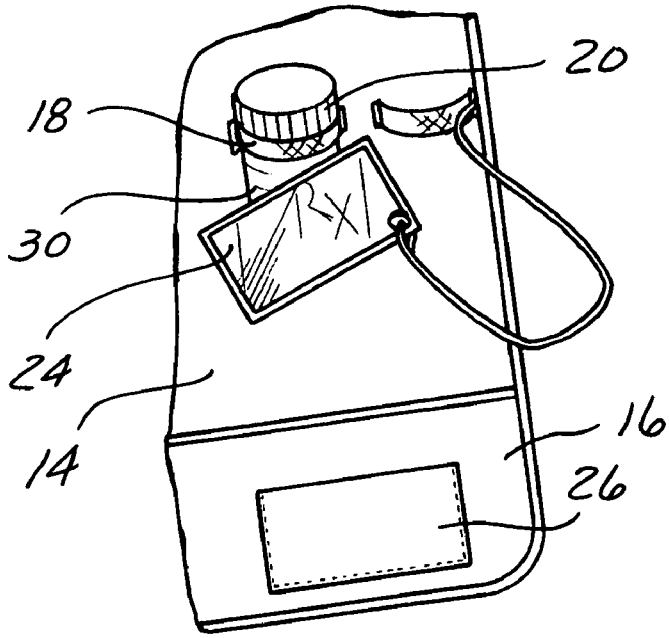
FIG. 3 is a fragmentary view of a portion of the combination prescription pill container organizer and carrier showing a tethered magnifier strip removed from a storage pocket.

Additionally, a plastic magnifier strip 24 stowable in a pocket 26 is attached with a tether 28 sewn to the inside of center panel 14. The magnifier strip 24 can be used to read prescription labels 30 on the prescription pill containers 20 or informational literature in the pocket 22, as shown in FIG. 3.

The upper panel 12 has a first hook or loop strip 32 attached thereto designed to mate with a second hook or loop strip 34 on the outside of the bottom panel 16.

When the bottom panel 16 is folded over the inside panel, the hook or loop strips 32, 34 mate to secure the panels 12, 14, 16 in the folded up, closed up condition.

Figure 2:
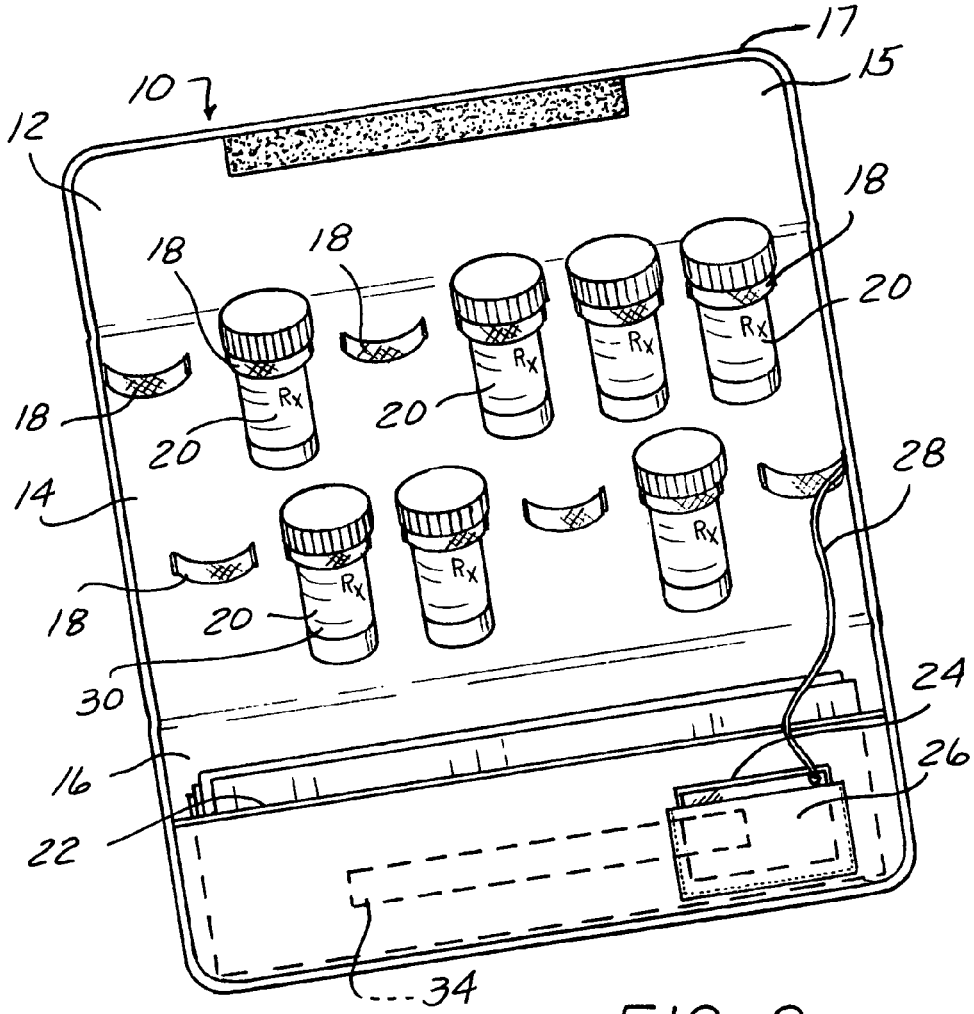
FIG. 2 is a pictorial view of the combination prescription pill container organizer and carrier shown in FIG. 1 in the unfolded condition to display rows of the holders and pill containers stowed therein, as well as other features thereof.

As seen in FIG. 2, the prescription pill containers 20 are arranged in neat rows with the labels exposed so as to be readily viewed and organized so as to be kept in an orderly way to make selection easier and to avoid mistakes.

The prescription pill containers 20 are also easily transported maintaining this orderly storage.

With the panels 12, 14, 16 folded up, the prescription pill containers 20 are completely and securely enclosed.

The prescription pill container organizer and carrier 10 can be made in various configurations and sizes depending on the number of medicine vials required to be organized and carried.

Figure 4:
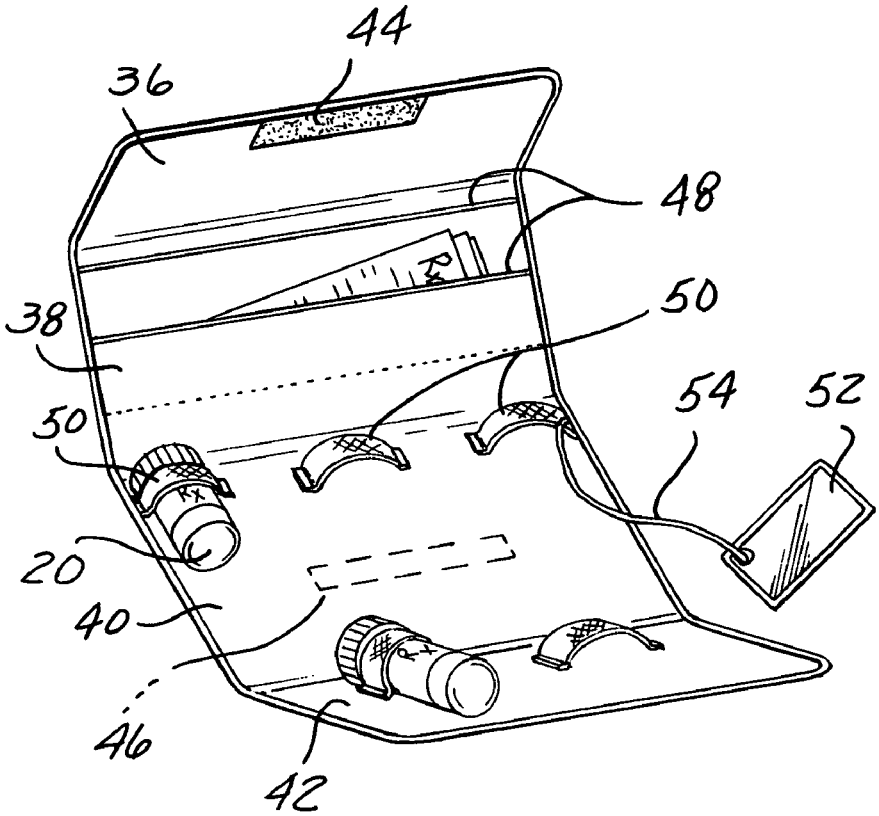
FIG. 4 is a pictorial view of a second embodiment of the combination prescription pill container organizer and carrier according to the present invention in the opened condition.

FIG. 4 shows a second more compact embodiment, in which four panel sections 36, 38, 40, 42 are provided. The topmost panel 36 acts as the outermost cover when the other three panels 38, 40, 42 are rolled or folded up, with a hook or loop strip 44 the inside of panel 36 mating with a hook or loop strip 46 on the outside of intermediate panel 40 to secure the panels in their rolled-folded up position.

In this embodiment, the second panel 38 has a pair of document pockets 48.

The intermediate panel 40 and the bottom panel 42 each have a row of holders 50 for holding prescription pill containers 20, comprised of elastic strap loops sewn or otherwise attached to the inside of panels 40, 42.

A magnifier strip 52 is held with a tether 54 attached to the panel 40, which may be stowed in one of the pockets 48.

Thus, the prescription pill containers are organized in orderly rows, with the labels readily viewable, yet are securely stored and enclosed when the panels are folded up (or rolled up). The carrier is compact and readily carried, and is attractive in appearance.

The invention claimed is:

1. A prescription pill container organizer and carrier, comprising:

a flexible sheet piece having several panel sections, including an outer section, at least one intermediate section, and an end section, said sections folded together so that an inside of said end section overlies said at least one intermediate section, and said outside section is folded over said outside section;

said at least one intermediate section having a row of prescription pill container holders each able to securely hold a prescription pill container which containers are thereby displayed when said outer and end sections are unfolded, said at least one intermediate section large enough to accommodate said prescription pill containers and, a magnifier attached to one end of a tether, the other end of the tether attached to one of said panel sections.

2. In combination, containers of prescription pills and an organizer and carrier, comprising:

a flexible sheet piece having several panel sections, including an outer section, at least one intermediate section, and an end section, said sections folded together so that an inside of said outer section overlies said at least one intermediate section and said end section is folded over said outer section;

said at least one intermediate section having a row of prescription pill container holders each holder able to securely hold a container of prescription pills, at least several containers of prescription pills disposed in corresponding holders, said prescription pill containers held therein displayed when said outer and end sections are unfolded, said at least one intermediate section having a depth able to accommodate said containers, each prescription pill container comprising a tubular bottle and a cap held on a top end thereof;

said holders comprising a row of loops attached to said at least one intermediate section, sized to allow insertion and holding of said prescription pill containers therein while leaving labels on said containers exposed for easy reference thereto.

3. The combination of containers of prescription pills and an organizer and carrier according to claim 2 wherein said loops are comprised of elastic straps.

4. The combination of containers of prescription pills and an organizer and carrier according to claim 2 wherein one or more flat document pockets are formed extending across the inside of at least one of said panel sections able to receive documents.

5. The combination of containers of prescription pills and an organizer and carrier according to claim 2 wherein two rows of prescription pill container holders are secured to the inside of said panel sections.

6. The combination of containers of prescription pills and an organizer and carrier according to claim 2 wherein said panel sections are each comprised of fabric material.

7. The combination of containers of prescription pills and an organizer and carrier according to claim 6 wherein said panel sections are integral with each other along contiguous sides.

* * * * *